United States Patent [19]

Mulawski

[11] Patent Number: 4,733,490

[45] Date of Patent: Mar. 29, 1988

[54] ALIGNMENT-IMPACT INDICATOR FOR FIREARMS

[76] Inventor: Walter J. Mulawski, 11 Nevada Dr., Chelmsford, Mass. 01824

[21] Appl. No.: 919,804

[22] Filed: Oct. 16, 1986

[51] Int. Cl.[4] ..... F41G 1/54

[52] U.S. Cl. ..... 42/100; 33/234

[58] Field of Search ..... 33/286, 233, 227, 234; 42/100, 96

[56] References Cited

U.S. PATENT DOCUMENTS

| | | | |
|---|---|---|---|
| 1,537,517 | 5/1925 | Wheeling | 42/96 |
| 2,476,981 | 7/1949 | Horton | 33/234 |
| 3,112,567 | 12/1963 | Flanagan | 33/234 |
| 3,744,133 | 7/1973 | Fukushima et al. | 33/234 |
| 3,908,282 | 9/1975 | Steffan | 42/100 |
| 4,057,905 | 11/1977 | Piaja | 33/234 |
| 4,090,305 | 5/1978 | Cassidy | 33/234 |
| 4,095,347 | 6/1978 | Steffan | 33/234 |

*Primary Examiner*—Charles T. Jordan
*Assistant Examiner*—Michael J. Carone
*Attorney, Agent, or Firm*—Pearson & Pearson

[57] ABSTRACT

An indicator for adjusting the elevation of a firearm such as a shotgun, comprising a rubber-like grommet having a lesser diameter portion for insertion in the barrel of the gun at the muzzle, a sight guide for mounting on the grommet and having elevation indicia, a screw threaded through the grommet, a washer, and a nut threaded on the screw. Tightening the screw compresses the grommet longitudinally and expands it transversely to affix it in the barrel. At the same time, the mounted sight guide is pressed by an inward facing shoulder of the grommet against the muzzle. The indicia are aligned for zero elevation and then the gun adjusted to aim at the desired elevation indicia over the alignment button. The screw is loosened and the indicator removed so that the adjusted gun may be fired.

9 Claims, 3 Drawing Figures

ALIGNMENT-IMPACT INDICATOR FOR FIREARMS

FIELD OF THE INVENTION

The present invention relates to the sighting of firearms such as rifles and shotguns.

BACKGROUND OF THE INVENTION

Alignment of a firearm for firing presents problems peculiar to firearms such as rifles and shotguns, particularly when shooting at moving targets. Shooting at fowl, or skeet shooting requires rapid aim and immediate response by the target shooter. The target is moving and the time for getting off the shot is limited. It is understood in shooting, such as in trapshooting or fowl shooting, that because of the often rising motion of the target, and the tracking motion imparted to the weapon by the shooter, the gun should be aligned to shoot above the point of aim. The amount of this "rise" or elevation depends upon the distance to the target, and indeed, also upon the individual preference of the shooter. The purpose is to secure an alignment that will provide a shot pattern centered on the target which could also be a stationary target at the selected distance.

In U.S. Pat. No. 2,795,048 to Seymour, et al, June 11, 1957, for "Detachable Rear Sight For Shotguns", the patentee proposes a detachable sight for mounting on a shotgun to provide for aiming in the manner of a rifle for use when firing slug shot. U.S. Pat. No. 3,945,142 to Keppeler, March 23, 1976 for "Mount For A Sight On Firearms" describes a mount for a rifle, or the like, by applying a ring to the finished rifle or gun.

U.S. Pat. No. 3,975,851 to Benford, Aug. 24, 1976 for "Slug-ster Sight For A Shotgun", provides a detachable mounting on the rear barrel of a shotgun for a sight. The sight has a ramp for vertical adjustment of the sight, thereby providing adjustment for elevation. The sight is intended for use with a shotgun when employed with shot and a slug. U.S. Pat. No. 4,008,536 to Adams, Feb. 22, 1977 for "Detachable Gun Sight Mounts" describes a gun sight mount for front or rear sights which may be attached to a shotgun with a ventilated rib sight mount. A modification permits mounting when a ventilated sight rib is absent. In either case, the patentee proposes to mount a pair of such mountings on a gun, and on these readily attachable and detachable gun sight mountings a conventional rifle sight may be mounted.

U.S. Pat. No. 4,010,564 to Pettit, Mar. 8, 1977, for "Shotgun With Adjustable Ventilated Sight Rib" describes a ventilated sight rib mounting for a shotgun having a mechanism for adjusting the elevation of the forward part of the sight. The sight rib is pivoted at its rearward end on a horizontal transverse axis by adjusting links at the forward end of the rib. The rib may move slidably to permit the adjustment. U.S. Pat. No. 4,117,617 to Linde, et al, Oct. 3, 1978 for "Adjustable Sighting Rib" suggests a shotgun having a sighting rib. The slope of the rib is adjusted by raising (or lowering) the front of the rib more than the rear of the rib in such a manner that the center of rotation is approximately at the point where a shooter places his eye when aiming. By this means, the patentee suggests the shooter may place his cheek at the same place on the stock at each shot, rather than adjust for the different positions of the rib. U.S. Pat. No. 4,143,465 to White, Mar. 13, 1979 for "Sighting Device" describes an attachment for a shotgun rib to allow ready adjustment of the sights for different elevation of the shot pattern. The purpose is to provide a shotgun sighting that is readily adjustable.

SUMMARY OF THE INVENTION

According to the invention an indicator for adjusting the elevation of the impact center of the shot pattern for a firearm such as a shotgun comprises a sight guide having indicia, a grommet for insertion in the muzzle and means for affixing the grommet in the muzzle, and for mounting the guide at the muzzle facing the barrel for sighting. The indicia has one or more markers for indicating respectively the different elevation impact centers of shot pattern for a selected distance. By use of the indicator one may adjust the elevation adjustment of the gun to match the selected elevation marker of the indicia for the selected distance. The means for affixing the guide may comprise a grommet of rubber-like material, a screw and nut for compressing the grommet to expand into and engage the barrel. The sight guide may be mounted on the grommet between the grommet and the muzzle. As a method of operation the shooter inserts the grommet in the muzzle of the gun. Then he places the sight guide in place and affixes the grommet to the barrel by tightening a nut on the screw to compress the grommet. The resulting expansion of the grommet tightens it in the barrel and affixes it to the barrel while the compression fastens or tightens the guide between the muzzle and grommet. After the sighting is adjusted the screw is loosened, the grommet returns to its original shape, and the assembly of grommet, guide, screw, washer and nut is removed from the barrel and the gun is ready to be discharged.

DESCRIPTION OF THE DRAWING

The various objects, advantages, and novel features of the invention will be more fully apparent from the following detailed description when read in connection with the accompanying drawing, in which like reference characters refer to like parts, and in which.

DETAILED DESCRIPTION

Figure 1:
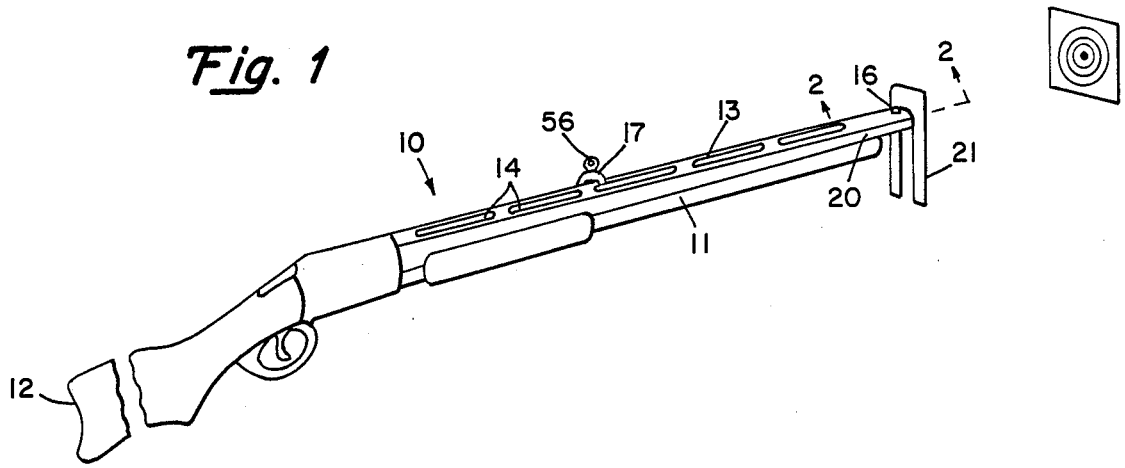
FIG. 1 is a partial perspective view, somewhat schematic, showing a firearm and the mounted indicator of the invention.
Figure 2:
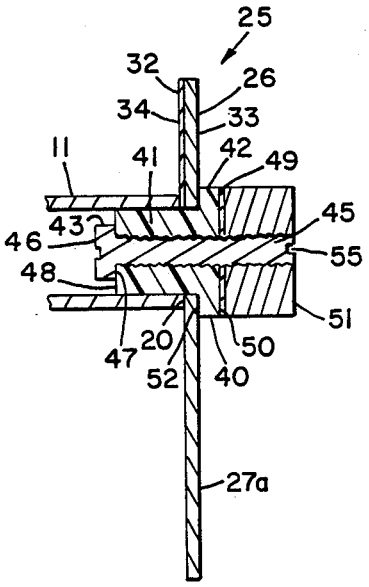
FIG. 2 is an enlarged sectional view along the barrel axial line 2—2 of FIG. 1.

Referring to the figures, a firearm 10 comprises a barrel 1, and a partially shown stock 12. A ventilated sight rib 13 is mounted on the barrel 11 and has cooling apertures 14. On the sight rib 13 are mounted a forward or front sight 16, and a rear sight 17. The shotgun 10 is provided with a means for raising or lowering one end of the sight rib, here indicated as the rear end, relative to the other, or other means for adjusting the elevation of the gun 10 for firing, such as adjusting the stock. At the muzzle 20 is an indicator 21.

Figure 3:
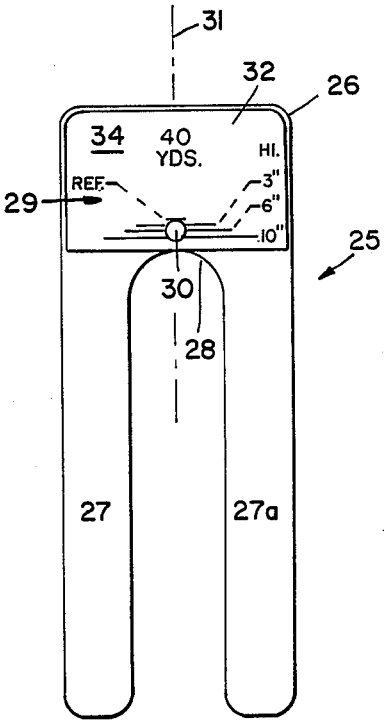
FIG. 3 is an enlarged front face view of the sight guide of FIG. 1.

The indicator 21 comprises a flat sight guide 25 for a selected distance, shown in FIG. 3 as 40 yds. The selected distance may be 16, 32, or other desired sighting distance. The flat sight guide 25 has an upper body portion 26, and a pair of depending legs 27 and **27*a* joined to each other by an arc 28 at their junction with the body portion 26. The front 34, of the body portion 26 bears indicia 29 for sighting comprising a target-like circle 30 and four parallel elevation lines designated "REF" (reference), 3", 6", and 10" respectively. The uppermost reference line is tangent to the top of the target circle 30, and perpendicular to the axis 31 of the sight guide 25. This axis 31 is perpendicular to the elevation lines and parallel to the extension of the legs 27 and 27***a*. The indicia 29 may be marked on a pressure sensitive backing 32 (of paper or other thin material) for application and adhesion to the front face 34, or the rear face 33, of the upper body portion 26, or may be scribed on either side. There may be different indicia on each side for different sighting arrangements depending on the situation.

The grommet 40 of rubber or other rubber-like material is of lesser outer diameter at 41 and of larger outer diameter cylindrical section 42 of grommet 40 extending outside the muzzle 20. The grommet 40 in place is coaxial with barrel 11. A screw 45 has a head 46 at one end 43 and extends coaxially through the grommet 40. A shoulder 47 of the screw 45 bears against the inner face 48 of the grommet 40. A flat washer 49 bears against the outer face 50 of the grommet 40, fastened by a nut 51 threaded at the other end 53 on the screw 45. Thus, the nut 51, washer 49, and screw 46, hold in place the sight guide 25 with the arc 28 resting on the grommet 40, and with the depending legs 27 and 27*a* down and the guide secured against the end of muzzle 20 by an inner facing shoulder 52 of the grommet 40 as the nut 51 compresses the grommet 40. The circle 30 is aligned with the front sight 16, and rear sight 17. The reference line marks the straight line from the guides 16 and 17.

To affix the sight guide to the gun 10, one first threads the screw 45 through the grommet 40 entering the lesser diameter section 41 first, then through the washer and then for a few turns onto the nut 51. Next, one inserts the section 41 into the muzzle 20, drops the sight guide 25 into place astride the grommet 40, and tightens the nut 51. One may use a screwdriver slot 55 in the screw 45, opposite head 46 to assure relative rotation of screw 45 and nut 51. The resulting longitudinal compression of the grommet 40 causes transverse expansion of the grommet 40, and so affixes the grommet in the gun muzzle 20. The tightening of the nut 51 also causes the innerfacing shoulder 52 to be pressed against, and firmly retain, the guide 25 against the muzzle to hold it in a position at right angles to the gun barrel axis. The thickness of the pressure sensitive backing 32 is so thin that its effect in tilting the guide may be ignored.

The sight guide 25 is set in place so that the reference line is aligned with the forward and rear sights 16, 17, usually with the gun adjusted for zero elevation, for example, with the rib flush to barrel. One may then adjust the gun elevation to bring the desired elevation line of the indicia (3", 6", or 10" as selected) into alignment with the sights. For instance, at an impact yardage of 32 yards and 40 yards using the bottom of the target as a reference point, the impact indicator determines a shot spread of 3", 60% above target, 40% below, 6", 70% above target, 30% below, 10", 83% above target, 17% below.

The screw is now loosened, the grommet 40 and guide 25 removed, and the shotgun is ready for firing at targets at, or near, the selected distance. The circle 30 and reference line are chosen so that the circle 30 is just covered by the front sight 16 of the usual firearm and the reference line is then just tangent to this circle 30. If necessary for different weapons, this construction may be varied as required.

In order to assist in aligning the sights, one may use a sighting button 56, which one drops on the rear sight in achieving the desired alignment. The sighting button 56 has a thickness to match the rear sight guide, and thus obviates the necessity of lateral alignment in securing vertical alignment to the desired elevation line on the indicia.

Those engaged in, for example, shotgun firing for trapshooting, or for fowl, encounter many difficulties in accurately aligning the gun for a desired elevation for a particular distance. One technique is to make repeated firings against a fixed target with a fixed weapon and find the relation between the target center and the center of the shot pattern. Then, after several firings and taking averages, the gun adjustment may be calibrated for a particular distance. Then the calibration should be repeated for another distance, if a very large variation. Actual firing of the weapon in trapshooting, or fowl shooting, is a complicated coordination of hand and eye, using the sights and the sight rib as a guide for a moving target, including tracking the target. Therefore, the calibration as described above may not be satisfactory. Furthermore, such a calibration is expensive in ammunition and tedious in time, and also requires access to a suitable firing range for the time needed. See for example, the article in "Shotgun Sports" for July 1985 by Don Butz entitled "Vertical Lead—How Much Is Enough?".

In preparing the indicia used for the present guide 25, the indicia are scribed in accordance with a trigonometric calculation. A marksman usually knows his own preference for the elevation he desires, or requires, in actual shooting. Thus, by using the precepts of the invention, he may with economy of time and the expenditure of ammunition, mount the guide for a desired distance and align the sights quantitatively for the desired elevation, and be prepared for shooting with an economy of time and expense difficult, if not impossible otherwise to achieve. One expert who has observed the indicator of the present invention states that it is the first which gives the shooter the opportunity to quantitatively adjust a series of guns to the same point of impact, and states that he found the invention simple, effective, and easy to use. Note that many trapshooters have a series of trap guns.

Thus, the invention provides an improved method and means for aligning a firearm whether for trapshooting, skeet, or fowl shooting. This novel method and means affords many advantages; it is not necessary to fire one or more test patterns to determine how high or low the center of the pattern impacts for a particular adjustment of the gun; an adjustment for a short or long yardage takes only minutes, being only the time needed to secure the indicator and make the sight adjustment; one can prepare special indicators for particular guns or for a personal preference for impacing and alignment.

I claim:

1. An indicator for indicating the impact center of shot patterns for a firearm having a barrel with a muzzle and having elevation adjusting means, comprising:

a sight guide for a selected distance and having indicia;

a grommet of rubber-like material for insertion in the barrel of the muzzle; and means for affixing the grommet in the muzzle and for mounting the guide at the muzzle end facing the barrel for sighting;

the indicia having a marker for indicating the elevation impact center of shot pattern for a selected distance;

the barrel having a longitudinal axis, said means for affixing the grommet in the muzzle and for mounting the guide comprising means for compressing the grommet longitudinally thereby causing the grommet to expand transversely of the axis to engage the barrel, said means for mounting the guide comprising the axial compressing means pressing against and retaining the guide against the muzzle, whereby one preparing for shooting may adjust the firearm elevation adjusting means to match the selected sighting elevation marker of the indicia for the selected distance.

2. An indicator as claimed in claim 1, said means for compressing the grommet further comprising:

a screw through the grommet and having a head engaging the grommet internally, the screw extending externally longitudinally of the barrel;

a washer engaging the grommet externally; and a nut threaded on the screw to engage the washer;

whereby turning the nut on the screw compresses the grommet longitudinally between the screw head and the washer, and the grommet thereby expands transversely to engage the inside of the barrel.

3. An indicator as claimed in claim 2, said grommet having an extension longitudinally outside the barrel, the means for mounting the guide comprising a shoulder, the guide being mounted and pressed between the shoulder and the muzzle.

4. An indicator as claimed in claim 1, said guide comprising a flat member substantially in a plane transverse to the axis and having a body and two depending legs for embracing the grommet externally, the body resting on the insert with the body upright above the barrel and having a planar portion facing the barrel.

5. An indicator for indicating the impact center of shot patterns for a firearm having a barrel with a muzzle and having elevation adjusting means, comprising:

a sight guide for a selected distance and having indicia;

a grommet of rubber-like material for insertion in the barrel of the muzzle; and means for affixing the grommet in the muzzle and for mounting the guide at the muzzle end facing the barrel for sighting;

the indicia having a marker for indicating the elevation impact center of shot pattern for a selected distance;

the barrel having a longitudinal axis, the guide comprising a flat member substantially in a plane transverse to the axis and having a body and two depending legs for embracing the grommet externally, the body resting on the insert with the body upright above the barrel and having a planar portion facing the barrel.

whereby one preparing for shooting may adjust the elevation adjusting means to match the selected sighting elevation marker for the indicia for the selected distance.

6. An indicator as claimed in claim 5 wherein the indicia is applied to the front face of the guide.

7. An indicator as described in claim 5 wherein the indicia is applied to the front and rear face of the guide.

8. A method of aligning a shotgun for shooting at a selected distance comprising the steps of:

inserting a rubber-like grommet in the muzzle of the gun;

inserting an indicator plate between the grommet and the muzzle of the gun, the plate having elevation indicia;

then expanding the grommet to engage the grommet in the barrel and to hold the indicator plate against the muzzle;

then adjusting the sight alignment by aiming at the indicator for the selected elevation;

sighting the indicator through an alignment button and removing the grommet and indicator.

9. A method as claimed in claim 8 comprising the step of selecting an indicator plate for the selected distance.

* * * * *